299-13 SR
1/3/84 XR 4,423,908

United States Patent [19] [11] 4,423,908
Ricketts [45] Jan. 3, 1984

[54] FORMATION OF AN IN SITU OIL SHALE RETORT WITH CONTROL OF MOUNDING

[75] Inventor: Thomas E. Ricketts, Grand Junction, Colo.

[73] Assignee: Occidental Oil Shale, Inc., Grand Junction, Colo.

[21] Appl. No.: 277,852

[22] Filed: Jun. 26, 1981

[51] Int. Cl.[3] ..... E21C 00/00
[52] U.S. Cl. ..... 299/2; 299/13
[58] Field of Search ..... 299/2, 13; 166/299, 166/259

[56] References Cited

U.S. PATENT DOCUMENTS

| | | | |
|---|---|---|---|
| 840,307 | 1/1907 | Ford | 299/13 |
| 3,434,757 | 3/1969 | Prats | 299/13 X |
| 3,848,927 | 11/1974 | Livingston | 299/13 |
| 4,022,511 | 5/1977 | French | 299/2 |
| 4,025,115 | 5/1977 | French et al. | 299/2 |
| 4,043,596 | 8/1977 | Ridley | 299/2 |
| 4,043,597 | 8/1977 | French | 299/2 |
| 4,201,419 | 5/1980 | Hutchins | 299/2 |

*Primary Examiner*—Stephen J. Novosad
*Attorney, Agent, or Firm*—Christie, Parker & Hale

[57] ABSTRACT

A method for forming a fragmented permeable mass of oil shale particles in an in situ oil shale retort in a subterranean formation containing oil shale is provided. At least one void is excavated within the retort site in the subterranean formation while zones of unfragmented formation are left adjacent such a void. The zones of unfragmented formation are then explosively expanded toward the void for forming the fragmented permeable mass of formation particles in the retort. To provide a fragmented mass with a flat top surface and reasonably uniform void fraction distribution, at least one of the zones of unfragmented formation is explosively expanded toward the void in a plurality of contiguous regions. Each such contiguous region has a free face adjacent the void and is expanded by first explosively expanding a first portion of that region toward the void. The free face of the first portion expanded is near the center of its respective region. Thereafter, a second portion of each region is expanded toward the void. The free face of the second portion is adjacent the free face of the first portion and surrounds the free face of the first portion. Remaining portions of each region are then expanded toward the void in sequence radially outwardly from the next previously expanded portion.

50 Claims, 7 Drawing Figures

FORMATION OF AN IN SITU OIL SHALE RETORT WITH CONTROL OF MOUNDING

FIELD OF THE INVENTION

This invention relates to the formation of an in situ oil shale retort containing a fragmented permeable mass of formation particles in a retort site within a subterranean formation containing oil shale. More particularly, this invention relates to a method for explosively expanding unfragmented formation toward a void excavated in the retort site for providing the fragmented permeable mass formed by such explosive expansion with a reasonably flat top surface and uniform lateral void fraction distribution.

BACKGROUND OF THE INVENTION

The presence of large deposits of oil shale in the high plateau, semi-arid region of the western United States has given rise to extensive efforts to develop methods for recovering shale oil from kerogen in the oil shale deposits. It should be noted that the term "oil shale" as used in the industry is, in fact, a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents such as U.S. Pat. Nos. 3,661,423; 4,043,597; 4,043,598; and 4,192,554; and in U.S. patent application Ser. No. 070,319 filed Aug. 27, 1979, by Chang Yul Cha, entitled TWO-LEVEL, HORIZONTAL FREE FACE MINING SYSTEM FOR IN SITU OIL SHALE RETORTS, now abandoned. Each of these applications and patents is assigned to Occidental Oil Shale, Inc., assignee of this application, and each is incorporated herein by this reference.

These patents and applications describe in situ recovery of liquid and gaseous hydrocarbon materials from a subterranean formation containing oil shale, wherein such formation is explosively expanded to form a stationary fragmented permeable mass of formation particles containing oil shale within the formation, referred to herein as an in situ oil shale retort, or merely as a retort. Retorting gases are passed through the fragmented mass to convert kerogen contained in the oil shale to liquid and gaseous products, thereby producing retorted oil shale. One method of supplying hot retorting gases used for converting kerogen contained in the oil shale as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and a portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbons, and a residual carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off-gas is withdrawn from the bottom of the retort. Such off-gas can include carbon dioxide generated in the combustion zone, gaseous products produced in the retorting zone, carbon dioxde from carbonate decomposition, and any gaseous retort inlet mixture that does not take part in the combustion process.

U.S. Pat. Nos. 4,043,597; 4,043,598; and 4,192,554 disclose methods for explosively expanding formation containing oil shale toward horizontal free faces to form a fragmented mass in an in situ oil shale retort. According to such a method, a plurality of vertically spaced apart voids of similar horizontal cross-section are initially excavated one above another within the retort site. A plurality of vertically spaced apart zones of unfragmented formation are temporarily left between the voids. A plurality of horizontally spaced apart vertical columnar explosive charges, i.e., an array of explosive charges, is placed in each of the unfragmented zones and detonated to explosively expand each unfragmented zone upwardly and/or downwardly towards the void or voids above and/or below it to form a fragmented mass having an average void volume about equal to the void volume of the initial voids. Retorting of the fragmented mass is then carried out to recover shale oil from the oil shale.

U.S. patent application Ser. No. 070,319 discloses a method for explosively expanding formation containing oil shale towards a horizontal free face to form a fragmented mass in an in situ oil shale retort. According to such a method, a void having a horizontal cross-section similar to the horizontal cross-section of the retort being formed is initially excavated adjacent the bottom of the retort site. A zone of unfragmented formation is left above the void. Explosive is placed in each of a plurality of vertically spaced apart layers of such overlying zone and detonated for explosively expanding such layers toward the void to form a fragmented mass in the retort having an average void volume about equal to the void volume of the initial void. The overlying layers can be expanded towards the void in a single round or in a plurality of rounds. If desired, an uppermost layer can also be explosively expanded towards an overlying void. Retorting of the fragmented mass is then carried out to recover shale oil from the oil shale.

When forming an in situ oil shale retort by explosive expansion of oil shale toward one or more voids, mounding of the fragmented mass of formation particles can occur. When mounding occurs, the fragmented mass of particles formed does not completely fill the available void space and additionally has a top surface that is not flat. For example, mounding occurred in a retort, resulting in a fragmented mass having a top surface relatively higher near the center of the retort and relatively lower near the retort's side boundaries.

When a fragmented mass of formation particles has an uneven, i.e., non-flat, top surface, problems can arise during subsequent blasting operations and/or during retorting operations. These problems can be more severe as the degree of mounding increases.

For instance, when formation is expanded toward a horizontally extending void in layers, the shape of the fragmented mass of particles from the first layer expanded can affect the void fraction distribution within the fragmented mass formed from subsequent layers. When the fragmented mass formed from each such layer has a flat surface, however, the uniformity of void fraction distribution within the entire fragmented mass is enhanced.

Further, it is desirable that a combustion zone formed in a fragmented mass of formation particles be flat and extend across the entire horizontal cross-section of the retort. When the combustion zone is not flat, the efficiency of the retorting operation can be reduced.

For instance, a retorting zone advancing in front of a combustion zone tends to have about the same shape as the combustion zone. When the combustion zone is not flat, some of the products formed in less advanced portions of the retorting zone can be consumed in more advanced portions of the combustion zone.

Also, retorting operations are desirably stopped before off-gas temperatures increase sufficiently to damage recovery equipment. The temperature of off-gas is increased as the combustion zone approaches the bottom of the retort. Therefore, when the combustion zone is not flat, some portions of the combustion zone reach the bottom of the retort before other portions. This can result in off-gas temperatures being high enough to require that retorting be discontinued before all of the oil shale in the retort is processed.

In the past, combustion zones have been formed by igniting the top surface of the fragmented mass of formation particles in the retort. The combustion zone formed tends to have about the same shape as the top surface of the fragmented mass. Therefore, when the top surface is not flat, the combustion zone formed is also not flat.

Unless corrective measures are taken, the combustion zone can maintain its non-flat shape during its advance through the retort, resulting in the inefficiencies of retorting described above.

On the other hand, measures required to flatten a combustion zone can be expensive and time-consuming.

It is, therefore, desirable to provide an economical method for expanding unfragmented formation toward a void(s) that results in a fragmented permeable mass of formation particles that has a generally flat top surface.

SUMMARY OF THE INVENTION

This invention relates to a method for explosively expanding unfragmented formation toward a void in a subterranean formation. At least one void is excavated in the subterranean formation and a zone of unfragmented formation is left adjacent such a void. The zone of unfragmented formation comprises a plurality of contiguous regions wherein each such region has a free face adjacent the void. Each region is explosively expanded toward the void in a single round by explosively expanding a first portion of each such region toward the void and thereafter explosively expanding a second portion of each such region toward the void. The free face of each such first portion is near the center of its respective region and the free face of the second portion is adjacent the free face of the first portion and surrounds the free face of the first portion.

DRAWINGS

These and other features, aspects, and advantages of the present invention will be more fully understood when considered with respect to the following detailed description, appended claims, and accompanying drawings wherein:

DETAILED DESCRIPTION

Figure 1:
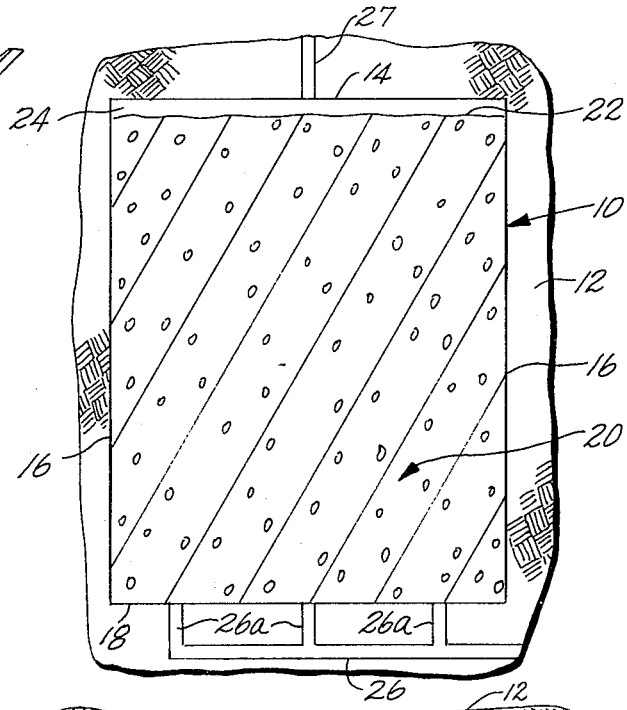
FIG. 1 is a semi-schematic vertical cross-sectional view of an in situ oil shale retort containing a fragmented permeable mass of formation particles with a generally flat top surface formed in accordance with practice of principles of this invention.

Referring to FIG. 1, there is shown a semi-schematic vertical cross-sectional view of an exemplary embodiment of an in situ oil shale retort 10 formed in a subterranean formation 12 containing oil shale. The in situ oil shale retort has a generally horizontally extending top boundary 14, generally vertically extending side boundaries 16, and a generally horizontally extending bottom boundary 18 of unfragmented oil shale formation. A fragmented permeable mass of formation particles 20 containing oil shale is within the boundaries of the retort. The top surface 22 of the fragmented mass is reasonably flat and, in this embodiment, there is a void space 24 between the top surface of the fragmented mass and the top boundary 14 of the retort.

Access to the bottom of the retort 10, for withdrawal of liquid and gaseous products of retorting and the like, is provided through a generally horizontally extending access drift 26. The access drift 26 has one or more vertical raises **26*a*** extending upwardly therefrom into a bottom portion of the fragmented mass.

Access to the top of the in situ oil shale retort for introduction of oxygen-supplying gas such as air or air diluted with steam or off-gas or the like is provided through an inlet passage 27. Although, in this embodiment, the inlet passage 27 extends vertically to the top boundary 14 of the retort through overlying unfragmented formation, if desired, such an inlet can extend horizontally into the upper portion of the retort through a side boundary. If desired, more than one inlet can be provided.

As described above, when the top surface 22 of the fragmented permeable mass of formation particles in the retort is flat, a combustion zone formed across the surface also tends to be flat. This enhances the efficiency and overall economics of the retorting operation.

Details of exemplary embodiments of practice of this invention useful for forming an in situ oil shale retort such as the retort 10 can be understood by referring to FIGS. 2–7.

In one exemplary embodiment of forming the retort 10, which can be best understood by referring to FIGS. 2–5, a lower level void 28 is excavated in the subterranean formation 12 between the side boundaries 16 and adjacent the bottom boundary 18 of the retort site. Although not illustrated in the figures, one or more pillars of unfragmented formation can be left in the lower void 28 for temporary support of overlying unfragmented formation.

An upper level void 30 is excavated adjacent the top boundary 14 of the retort site and extends to the side boundaries 16. Although not illustrated in the figures, if desired, support pillars of unfragmented formation can be left in the upper level void 30 for temporary support of overlying unfragmented formation.

A zone of unfragmented formation 32 is left within the retort site extending between the upper and lower voids 30 and 28, respectively. The zone of unfragmented formation has an upper horizontally extending free face 34 which is the floor of the void 30 and a lower horizontally extending free face 36 which is the roof of the lower void 28. Explosive is placed into the zone of unfragmented formation 32 and then detonated at a desired time and in a desired delay sequence for explosively expanding the zone of unfragmented formation toward the voids. When support pillars are left in the void(s), they are explosively expanded prior to explosive expansion of the zone of unfragmented formation.

The volume of formation excavated to form the voids toward which unfragmented formation is explosively expanded is preferably between about 15 and about 40 percent of the total volume of the retort being formed. That is, the amount of formation is preferably between 15 to 40 percent of the total volume within the top, side, and bottom boundaries of the retort. It has been determined that voids comprising up to about 70 percent of the total volume within the top, side, and bottom boundaries of a retort toward which unfragmented formation is to be expanded can act as "limited voids". A "limited void" is a void having a volume less than the volume required for free expansion of all the oil shale explosively expanded toward such a void. When oil shale is explosively expanded toward an unlimited void, a certain maximum void fraction is present in the unfragmented mass, resulting from such free expansion. When oil shale is expanded toward a limited void, the void fraction can be no more than permitted by the available void space of the limited void and may be less due to interactions with unfragmented oil shale, for example. It is believed that with oil shale confined by surrounding walls and capable of expanding only to such a limited void, gases from the detonation may not have full opportunity to act on the oil shale particles before such particles reach obstructions, such as adjacent walls, a face opposite to the expanded formation, or oil shale expanding from the opposite sides of the void.

When limited voids are used, their effect on the shape of the fragmented mass formed is considered when designing a blasting pattern for use in accordance with this invention.

In an exemplary embodiment, a plurality of vertically extending horizontally spaced apart blastholes 38 are drilled downwardly into the zone of unfragmented formation from the upper level void 30. Alternatively, if desired, the blastholes can be drilled from the ground surface or from the lower level void 28. The blastholes of this embodiment are in a square array, i.e., the spacing between adjacent blastholes is about equal, and the array extends across the entire horizontal cross-section of the zone of unfragmented formation. Other arrays can be used, if desired, in practice of this invention.

After the array of blastholes is formed, explosive is first loaded into a bottom portion of each blasthole, forming a first array of explosive charges 40 in the zone of unfragmented formation. The first array of charges 40 is in the top half of a lower layer **32*a* of the zone of unfragmented formation. A plane passing through the centers of mass of the explosive charges is parallel to the free faces 34 and 36, i.e., the array extends parallel to the free faces 34 and 36**.

Figure 2:
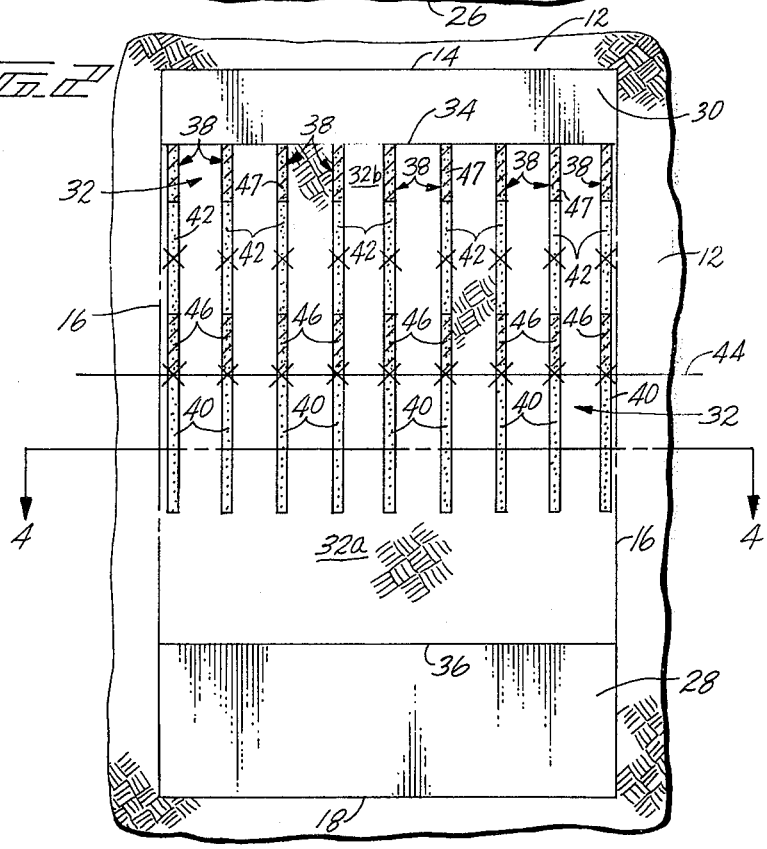
FIG. 2 is a semi-schematic vertical cross-sectional view of an exemplary embodiment of an in situ oil shale retort at one stage in its preparation in accordance with this invention.

The lower layer **32*a* can have any desired thickness and is shown in FIG. 2 as that portion of the zone of unfragmented formation below the horizontal plane 44. It is preferred that the thickness of such a layer is at least about 1½ times the distance between adjacent explosive charges for desired charge interaction. Additionally, it is preferred that the thickness of the layer is less than about ½ the minimum horizontal dimension of the retort for desired rock movement. Detonators designated by an "x" are placed into each charge 40 in the array to initiate detonation of the charges at the location in the charge most remote from the free face 36. After each charge 40 is in place, an inert stemming material 46 such as sand or gravel or the like is placed into each blasthole above each charge. The stemming preferably extends about ¼ the distance from the top of each charge to the top surface 34, i.e., the free face, of an upper layer 32*b* of the zone of unfragmented formation. In this embodiment, the upper layer 32*b* extends from the top of the lower layer 32*a* to the overlying void 30**.

Explosive is then placed into each blasthole 38 above the stemming, forming a second array of explosive charges 42 in the zone of unfragmented formation. The second array is preferably located in the middle half of the upper layer **32*b* of the zone of unfragmented formation and extends parallel to the free faces 34 and 36. Detonators designated by an "x" are placed into each charge 42 at about the centers of the charge columns and stemming 47** such as sand or gravel is placed into the blastholes above each charge.

After the blastholes 38 are loaded and final preparation for the explosive expansion has been made, the explosive charges are detonated. The charges 40 in the lower layer **32*a* of the zone of unfragmented formation are detonated first, resulting in explosive expansion of the lower layer 32*a* toward the lower level void 28**.

Figure 3:
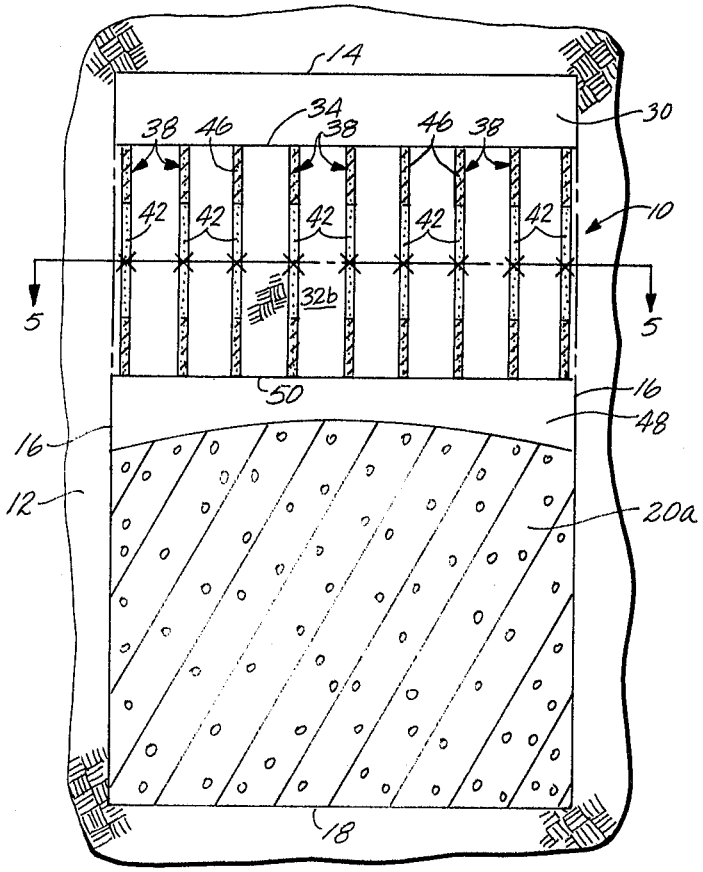
FIG. 3 is a semi-schematic vertical cross-sectional view of the in situ oil shale retort of FIG. 2 at another stage in its preparation in accordance with this invention.

As can best be seen in FIG. 3, in an exemplary embodiment, the explosive expansion of the lower layer results in the formation of a bottom portion 20*a* of the fragmented mass of formation particles within the boundaries of the retort site. At this stage of preparation of the retort 10, there is a void space 48 between the top surface of the bottom portion 20*a* of the fragmented mass and a new horizontally extending free face 50 which defines the bottom of the upper layer 32*b* of the zone of unfragmented formation 32. After expansion of the lower layer, either in a single round or after a substantial time delay, the explosive charges 42 in the upper layer are detonated for explosively expanding the upper layer both upwardly toward the upper level void 30 and downwardly toward the void space 48.

In an alternative embodiment, preferably both the upper and lower regions, 32*a* and 32*b* respectively, are explosively expanded in the same single round. In this instance, the portion 20*a* of the fragmented mass is not in a stationary body as shown in FIG. 3 at the time the upper region is expanded, but is still moving toward the bottom of the retort.

Detonation in a single round, as used herein, means detonation of a number of separate explosive charges, either simultaneously or with only a short time delay between separate detonations. A time delay between explosions in a sequence is short when formation explosively expanded by detonation of one explosive charge has either not yet moved or is still in motion at the time of detonation of a subsequent explosive charge.

In accordance with practice of principles of this invention, control of mounding, i.e., control of the flatness of the top surface of the fragmented mass of formation particles 20 formed in the retort, is provided by the location and sequence of detonations of the explosive charges in the two layers of the zone of unfragmented formation 32.

Figure 4:
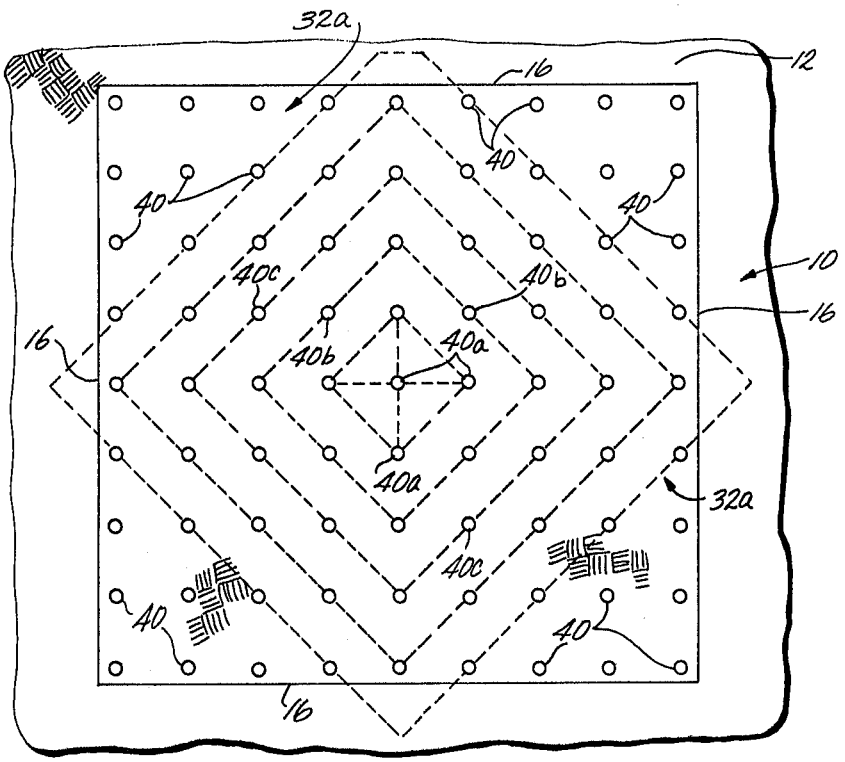
FIG. 4 is a semi-schematic horizontal cross-sectional view taken on line 4—4 of FIG. 2 showing an exemplary blasting pattern useful in practice of principles of this invention.
Figure 5:
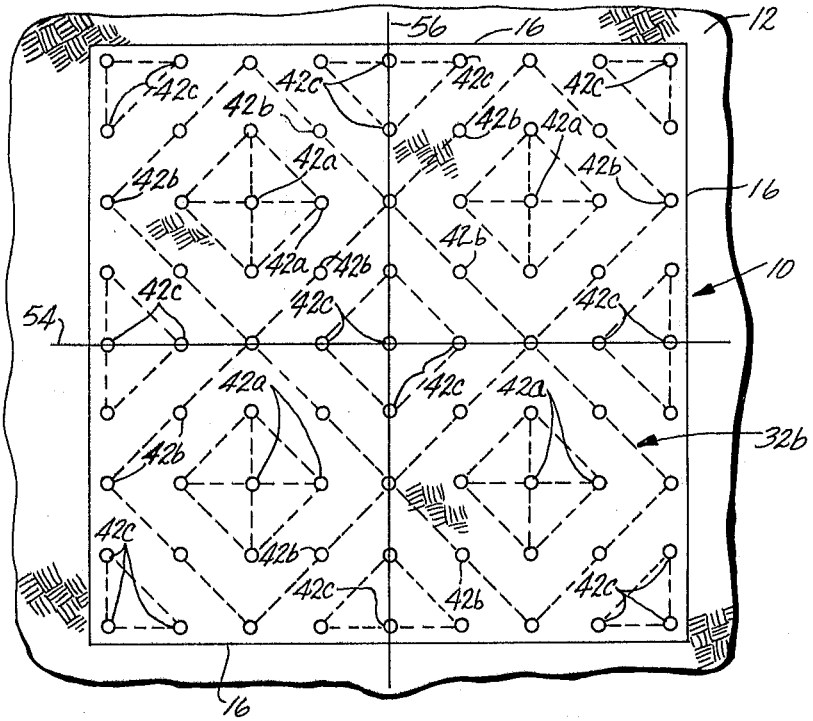
FIG. 5 is a semi-schematic horizontal cross-sectional view taken on line 5—5 of FIG. 3 showing another exemplary blasting pattern useful in practice of this invention.

Referring now to FIGS. 4 and 5, exemplary patterns showing the locations and sequence of detonations of charges useful in practice of this invention can be understood.

In one exemplary embodiment shown in FIG. 4, the lower layer 32*a* of the zone of unfragmented formation is explosively expanded by first initiating detonation of five explosive charges 40*a* at about the center of the lower layer. In each instance, the charges detonated on the same time delay are shown connected by dashed lines. After a time delay, eight explosive charges 40*b* located in a band surrounding the five charges 40*a* are detonated. The time delay between detonations is preferably in the order of about 1 millisecond per foot of spacing between adjacent charges 40*a* and 40*b*. After an additional time delay, twelve explosive charges 40*c* in a band surrounding the explosive charges 40*b* are detonated. Preferably, the time delay between detonation of the explosive charges 40*b* and the charges 40*c* is in the order of 1 millisecond per foot of spacing distance between adjacent explosive charges 40*b* and 40*c*. In this embodiment, the detonation sequence continues to progress radially outwardly from the center of the zone of unfragmented formation until all of the explosive charges 40 are detonated. This pattern or sequence of time delays used in detonating the array of explosive charges 40 is referred to herein as a "center-out initiation pattern".

Although, in this embodiment, there are 81 blastholes providing 81 explosive charges 40, other numbers of blastholes having different spacing patterns can be used in practice of this invention, if desired. Also, if desired, the blastholes at the corners of the retort can be eliminated.

Referring now particularly to FIG. 3, after the lower layer 32*a* of the zone of unfragmented formation has been expanded, thereby forming the portion 20*a* of the fragmented mass, either in a stationary body when separate rounds are used or still expanding toward the bottom of the retort when a single round is used, the explosive charges 42 in the upper layer 32*b* of the zone of unfragmented formation are detonated. Preferably, the upper layer is expanded toward the voids, i.e., the void 30 above it and the void space 48 below it, in a plurality of horizontally spaced continuous regions. Each of the contiguous regions extends vertically between the free face 50 adjacent the void space 48 and the free face 34 adjacent the void 30. Each region, therefore, has a free face at each end toward which formation from that region is expanded.

In practice of this invention, each such contiguous region is explosively expanded in a desired number of portions, each of which extends from the free face 34 to the free face 50. The first portion of each region expanded is preferably near the center of the region. The portion of each region expanded next is preferably adjacent the first portion and laterally spaced from it. Remaining portions are subsequently expanded in sequence, preferably with each such subsequent portion expanded adjacent the next previously expanded portion.

In order to enhance uniformity of void fraction distribution within the fragmented permeable mass of formation particles formed, it is preferable that the first portions of such regions are all explosively expanded about simultaneously and the second portion of said regions are all explosively expanded about simultaneously. Further, any remaining portions of the regions are explosively expanded in sequence with each of the respective portions of all of the regions expanded about simultaneously.

In an exemplary embodiment, which can be best understood by referring to FIG. 5, the upper layer 32*b* of the zone of unfragmented formation 32 is expanded in four regions toward the voids 30 and 48. For purposes of exposition herein, the regions are defined by vertical planes 54 and 56 and the explosive charges 42 that are detonated at the same time in each region are shown connected by dashed lines.

The blasting pattern used when expanding a zone of unfragmented formation in regions is referred to herein as a "region initiation pattern". In this instance, the blasting pattern is termed a "quadrant initiation pattern" because the zone of unfragmented formation is expanded in four similar regions or quadrants. The voids and the zone of unfragmented formation 32 are, in this embodiment, square in horizontal cross-section and preferably each quadrant is about the same size as each other quadrant. The quadrants have square free faces which meet at a common corner at the center of the zone of unfragmented formation.

In other embodiments, voids and the zones of unfragmented formation extending between such voids can have horizontal cross-sections other than square and the regions being explosively expanded can be other than square, if desired. Also, if desired, such a zone of unfragmented formation can be expanded in more or less than four regions.

In an exemplary charge initiation sequence when using the "quadrant initiation pattern" of this embodiment, five first explosive charges 42a at about the center of each region or quadrant are detonated first. Detonation of the five charges 42a expands a first portion of each region toward the voids. In this instance, the first portions extend from the free face 34 to the free face 50 and are located at about the center of their respective regions. The free faces at the ends of the first portion of each region are, therefore, at about the center of the area of the free faces of that region. Next, after a short time delay, eight second explosive charges 42b spaced radially from the center portion of each region and in a band surrounding the initial charges 42a are detonated. The time delay between detonation of the first explosive charges 42a and the second explosive charges 42b is preferably at least about 1 millisecond per foot of spacing between adjacent explosive charges 42a and 42b.

Detonation of the eight explosive charges 42b expands a second portion of each region toward the voids. The second portion expanded is adjacent the first portion, surrounds the first portion, and extends from the free face 34 to the free face 50. The free face of such a second portion at each of its ends is, therefore, adjacent the free face of the first portion and surrounds the free face of the first portion. Next, the explosive charges 42c, i.e., the next group of explosive charges spaced laterally outwardly from the charges 42b, are detonated after a time delay of at least about 1 millisecond per foot of spacing between adjacent charges 42b and 42c.

As described above, the sequence of initiation of detonation of explosive charges progresses generally radially outwardly from the center of each quadrant or region of the upper layer 32b until all explosive charges in the upper layer are detonated.

It appears that center mounding of a fragmented permeable mass of formation particles is to some extent due to the use of the above described "center-out initiation pattern" of detonation of explosive charges. Oil shale adjacent the center of the zone commences expanding first, thereby providing relief for expansion of oil shale surrounding the center. As a consequence, there is a general tendency for the expanding oil shale to push or move toward the center of the retort site, i.e., toward the locus of the first detonation. This action promotes mounding at the center of the retort, which can result in a band of relatively higher void fraction or permeability in the fragmented mass around the perimeter of the retort and a zone of relatively lower void fraction or permeability in the fragmented mass at the center of the retort.

When a "region initiation pattern" as described above is used, however, explosive expansion of oil shale tends to be directed toward the centers of each such region, e.g., in the illustrated embodiment toward the center of each quadrant. Thus, in effect, there is a tendency to form the same number of mounds as the number of regions used for forming the fragmented mass. The formation of such mounds nearer the corners of the retort site can compensate for the tendency of center mounding when using the "center-out initiation pattern". By explosively expanding the lower layer 32a of the zone of unfragmented formation using a "center-out initiation pattern" and the upper layer 32b of the zone of unfragmented formation using a "region initiation pattern", a balance of the two mounding effects can be obtained, thereby producing a reasonably flat top surface of the fragmented mass in the retort.

If additional compensation for center mounding is desired, the zone of unfragmented formation can be explosively expanded in three layers with two layers expanded using a "region initiation pattern" compensating for one "center initiated" layer.

Alternatively, two different "region initiated" layers can be employed with no "center initiated" layer since the magnitude of mounding, i.e., the difference between the highest and lowest regions of the mound, is less with region initiation than with center initiation.

In the illustrated arrangement, the lower layer 32a of the zone of unfragmented formation is "center initiated" and the upper layer of the zone of unfragmented formation is "region initiated". These positions can be reversed, if desired.

Other modifications and variations of practice of this invention can also be employed. For example, when using a "region initiation pattern" in combination with a "center-out initiation pattern", the first charges detonated can be somewhat closer to the corners of the retort site than nearer the center of the region for further counterbalancing the mounding effect of center initiation. The compensation for center mounding can also be increased by using longer time delays in the region initiated layers than mentioned above. Longer delays give additional time for expansion and added relief and are believed to result in greater tendency toward mounding near the locus of the first charge or charges detonated.

Further, when using a "region initiation pattern", unfragmented formation can be expanded in more or fewer regions as desired. The number of regions chosen appears in part to be a compromise between the desired uniformity of lateral void fraction distribution of the fragmented mass formed (evidenced by the surface flatness of the fragmented mass) and the amount of seismic vibration developed during the blast. For instance, it is believed that when the number of regions is increased, the uniformity of the lateral void fraction distribution of the fragmented mass formed is enhanced. Since, however, each respective portion of each region is expanded at about the same time, when more regions are used, seismic vibration can be increased.

Figure 6:
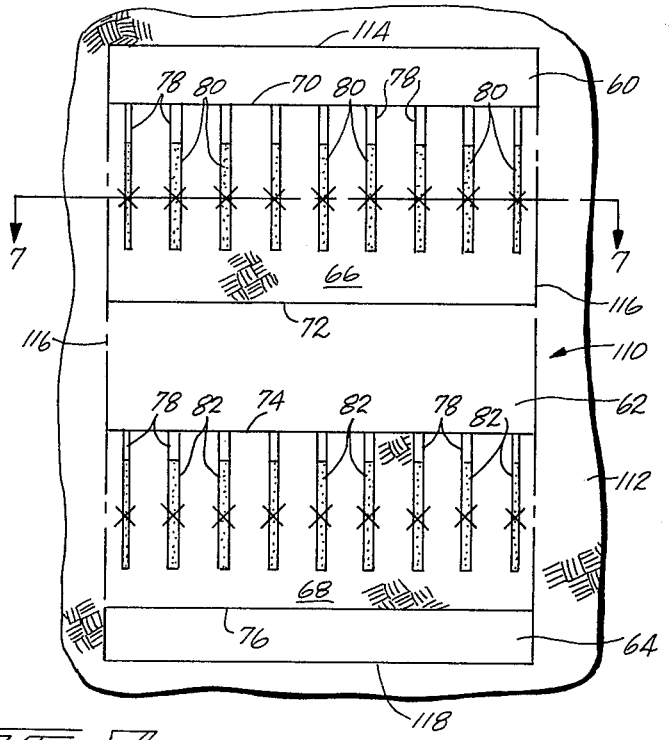
FIG. 6 is a semi-schematic vertical cross-sectional view of another exemplary embodiment of an in situ oil shale retort at one stage in its preparation in accordance with this invention.

Referring now to FIG. 6, there is shown a semischematic vertical cross-sectional view of another exemplary embodiment of an in situ oil shale retort 110 being formed in a subterranean formation 112 in accordance with practice of principles of this invention. The retort 110 has a top boundary 114, vertically extending side boundaries 116, and a bottom boundary 118 of unfragmented formation. A generally horizontally extending upper level void 60, a generally horizontally extending intermediate void 62, and a generally horizontally extending lower level void 64 are excavated in the formation within the boundaries of the retort site. An upper zone of unfragmented formation 66 is left extending between the upper and intermediate voids 60 and 62, respectively. A lower zone of unfragmented formation 68 is left extending between the intermediate and lower voids 62 and 64, respectively. The upper zone of unfragmented formation has a horizontally extending upper free face 70 defining the floor of the upper void and a horizontally extending lower free face 72 defining the roof of the intermediate void. The lower zone of unfragmented formation has a horizontally extending upper free face 74 defining the floor of the intermediate void and a horizontally extending lower free face 76 defining the roof of the lower void.

A plurality of vertically extending blastholes 78 are drilled into each of the zones of unfragmented formation, either from the void above the zone or from the void below the zone. In this embodiment, the blastholes are drilled from the voids above each respective zone of unfragmented formation and extend across substantially the entire horizontal cross-section of each zone. The blastholes around the perimeter of the retort site are preferably smaller and more closely spaced than the blastholes nearer the center of the retort site. This improves the distribution of explosive at the edges of the retort, resulting in an enhanced uniformity of fragmentation and lateral void fraction distribution across the retort and reduced seismic vibration from the blast.

An explosive charge 80 is placed into each of the blastholes, preferably in about the middle half of the upper zone of unfragmented formation, forming an array of horizontally spaced apart explosive charges 80 parallel to the free faces 70 and 72. An explosive charge 82 is placed into each of the blastholes, preferably in about the middle half of the lower zone of unfragmented formation, forming an array of horizontally spaced apart explosive charges 82 parallel to the free faces 74 and 76. Detonators designated by an "x" are in each charge 80 and 82 at about the center of each charge column.

The explosive charges 82 in the lower zone 68 of unfragmented formation are preferably detonated in a single round in a selected time delay sequence useful in practice of this invention, for explosively expanding formation upwardly toward the void 62 above and downwardly toward the void 64 below. Preferably, at about the same time the charges 82 are detonated, the charges 80 in the upper zone are detonated in a single round in the same selected time delay sequence for explosively expanding formation upwardly toward the void 60 and downwardly toward the void 62. The explosive expansion of the upper and lower zones of unfragmented formation forms a fragmented permeable mass of oil shale particles in the retort 110.

As was the case in the above described exemplary embodiments, control of mounding of the fragmented mass of particles in the retort 110 is provided by the location and selected time delay sequence of detonation of the explosive charges in the formation.

Figure 7:
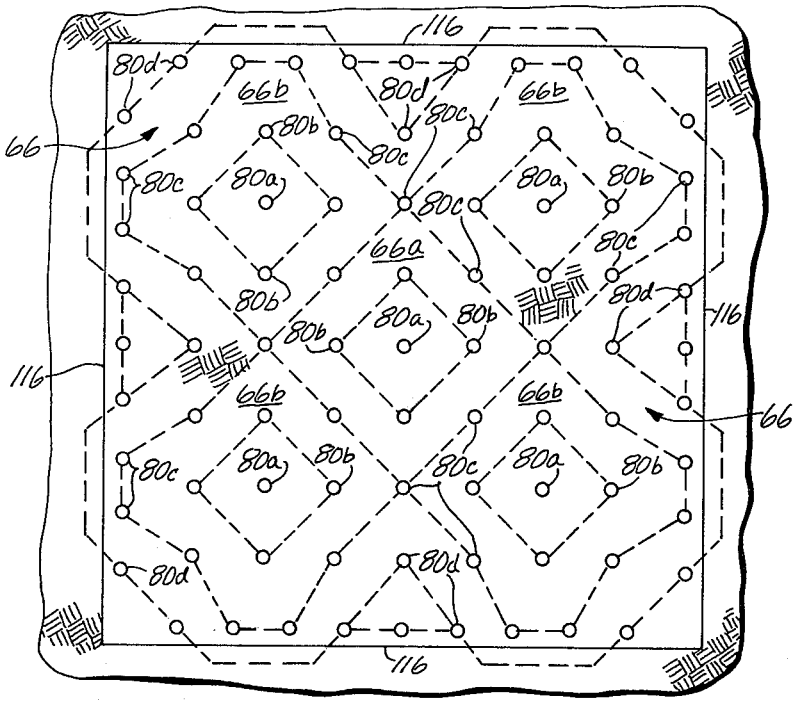
FIG. 7 is a semi-schematic horizontal cross-sectional view taken on line 7—7 of FIG. 6 showing yet another exemplary blasting pattern useful in practice of this invention.

In an exemplary embodiment, both the upper and lower zones of unfragmented formation 66 and 68, respectively, are expanded using a "region initiation pattern" similar to the region initiation patterns described above. Referring now to FIG. 7, there is shown a semi-schematic cross-sectional view of the upper zone of unfragmented formation taken on line 7—7 of FIG. 6. Preferably, in this instance, both the upper zone 66 and lower zone 68 are expanded in the same number of regions. Additionally, it is preferred that each region of the upper zone is about the same size as its respective region in the lower zone and is located about directly above its respective region in the lower zone.

In one embodiment, the upper zone 66 comprises five contiguous regions; a center region **66*a* at about the center of the zone and four outer regions 66*b* surrounding the center region with each outer region adjacent the center region. Each region extends from the lower free face 72 vertically to the upper free face 70** of the upper zone of unfragmented formation.

The upper zone 66 is explosively expanded toward the voids 60 and 62 by first initiating detonation of a plurality of the charges 80 at a plurality of first locations spaced apart from each other in directions parallel to the free faces 70 and 72. After a time delay, explosive charges 80 are initiated at locations in the array between the spaced apart first locations.

In one exemplary embodiment, a first portion of the center region **66*a* and a first portion of each outer region 66*b* are expanded about simultaneously toward the voids by first initiating detonation of charges 80*b* in the center of each region. Preferably, the charges 80*a* are in a quincunx. In this instance, the first portion of each region is at about the center of the region and extends from the free face 72 to the free face 70**. The free face at each end of the first portion of each such region is, therefore, at about the center of the area of the free face of its respective region.

After a time delay, the explosive charges **80*b* are detonated simultaneously for expanding a second portion of each of the five regions toward the voids. The charges 80*b* are each in a band radially spaced from and surrounding the charge 80*a* in the center of such a region. In this instance, therefore, the upper and lower horizontally extending free face of each second portion of each region is adjacent to and surrounds the respective free face of each first portion. The explosive charges 80*c* are thereafter detonated, followed by detonation of the explosive charges 80*b***.

Preferably, as was the case for the previously described embodiments, the time delay between explosive expansion of the first, second, and subsequent portions of each region is equal to at least about 1 millisecond per foot of spacing distance between adjacent explosive charges in each subsequent band of charges detonated.

In the illustrated embodiment, the explosive charges at about the center of each region are detonated first, followed by detonation of charges in each region sequentially radially outwardly until all the explosive charges are detonated. In each instance, the charges detonated on the same delay are shown connected by dashed lines.

Preferably, the lower zone 68 of unfragmented formation is explosively expanded using the same "region delay pattern" as used for expanding the upper zone. Additionally, it is preferred that the upper and lower zones are explosively expanded simultaneously so that equal amounts of formation are forced into equal void volumes for enhancing the uniformity of void fraction distribution.

If desired, a zone of unfragmented formation can be expanded in more or less than five regions. It has been determined, however, that where two layers of formation are expanded toward three voids, as is described in the illustrated embodiment, five regions are preferred. The use of five regions results in a fragmented mass with a particularly flat top surface without an undesirably high amount of seismic vibration being produced. For example, in one experiment, a fragmented mass about 160 feet square was formed and the top surface was very nearly flat with some piles up to about six feet high near edges and corners of the mass.

In another embodiment, when two zones of unfragmented formation are expanded toward three voids, a "center initiation pattern" can be used for expanding one of the zones of unfragmented formation while a "region initiation pattern" can be used for expanding the other.

Further, more than three voids can be excavated and the zones of unfragmented formation between each pair of voids can be explosively expanded toward the voids using a combination of center and region initiation patterns as desired.

After the unfragmented formation is explosively expanded forming the fragmented permeable mass 20 of oil shale particles in the in situ oil shale retort 10, as illustrated in FIG. 1, retorting operations can be commenced.

During retorting operations, a combustion zone is established in the fragmented mass of formation particles and is advanced downwardly through the fragmented mass by introduction of oxygen-supplying gas into the retort through the inlet 27. Combustion gas produced in the combustion zone passes through the fragmented mass to establish a retorting zone on the advancing side of the combustion zone, wherein kerogen in the oil shale is retorted to produce liquid and gaseous products of retorting. The liquid products and an off-gas containing gaseous products pass to the bottom of the fragmented mass and are withdrawn from the product withdrawal drift 26. A pump (not shown) is used to withdraw liquid products from a sump (not shown) to above ground. Off-gas is withdrawn by a blower (not shown) and passed to above ground.

The above description of a method for forming an in situ oil shale retort in a subterranean formation containing oil shale, including the description of detonation sequences used to expand zones of unfragmented formation, is for illustrative purposes. Because of variations which will be apparent to those skilled in the art, the present invention is not intended to be limited to the particular embodiments described above. The scope of the invention is defined in the following claims.

What is claimed is:

1. A method for explosively expanding unfragmented formation toward a limited void in a subterranean formation comprising the steps of:

(a) excavating a limited void in a subterranean formation while leaving a zone of unfragmented formation adjacent the void, the zone of unfragmented formation comprising a plurality of contiguous regions, wherein each such contiguous region has a free face adjacent the void; and (b) explosively expanding each such region of the zone of unfragmented formation toward the void in a single round by:

(i) explosively expanding a first portion of each such region toward the void, wherein the free face of each such first portion is near the center of its respective region; and thereafter (ii) explosively expanding a second portion of each such region toward the void, wherein the free face of the second portion is adjacent the free face of the first portion and surrounds the free face of the first portion.

2. The method according to claim 1 wherein the void is a horizontally extending void and the free face of each such region is horizontally extending.

3. The method according to claim 1 wherein the first portions of such regions are all explosively expanded about simultaneously and the second portions of such regions are all explosively expanded about simultaneously.

4. The method according to claim 1 wherein the zone of unfragmented formation is rectangular in horizontal cross-section and comprises four regions of about equal size, such regions having rectangular free faces which meet at a common corner at about the center of said zone.

5. The method according to claim 1 wherein the zone of unfragmented formation comprises five contiguous regions, a center region at about the center of the zone of unfragmented formation and four outer regions surrounding the center region, wherein each such outer region is adjacent the center region.

6. The method according to claim 5 wherein each such contiguous region is about the same size.

7. A method for explosively expanding unfragmented formation toward a limited void in a subterranean formation comprising the steps of:

(a) excavating a limited void in a subterranean formation while leaving a zone of unfragmented formation adjacent the void, wherein the zone of unfragmented formation comprises four contiguous regions having a free face adjacent the void; and (b) explosively expanding each region of the zone of unfragmented formation toward the void in a single round by:

(i) explosively expanding a first portion of each such region toward the void, wherein the free face of each such first portion is near the center of its respective region; and thereafter (ii) explosively expanding a second portion of each such region toward the void, wherein the free face of the second portion of each such region is adjacent the free face of the first portion and surrounds the free face of the first portion.

8. The method according to claim 7 wherein the void is a horizontally extending void and the free face of each such region is horizontally extending.

9. The method according to claim 8 wherein the void is generally square and each region comprises one generally square quadrant adjacent the void.

10. The method according to claim 7 wherein the first portions of such regions are all explosively expanded about simultaneously and the second portions of such regions are all explosively expanded about simultaneously.

11. A method for explosively expanding unfragmented formation toward a limited void in a subterranean formation comprising the steps of:

(a) excavating a void in a subterranean formation while leaving a zone of unfragmented formation adjacent the void, wherein the zone of unfragmented formation comprises five contiguous regions, each such region having a free face adjacent the void, wherein a center region is at about the center of the zone of unfragmented formation and four outer regions surround the center region and are adjacent the center region;

(b) explosively expanding each contiguous region of the zone of unfragmented formation toward the void in a single round by:

(i) explosively expanding a first portion of each such region toward the void, wherein the free face of each such first portion is near the center of its respective region; and thereafter (ii) explosively expanding a second portion of each such region toward the void, wherein the free face of the second portion of each such region is adjacent the free face of the first portion and surrounds the free face of the first portion.

12. The method according to claim 11 wherein the void is a horizontally extending void and the free face of each such region is horizontally extending.

13. The method according to claim 11 wherein the first portions of such regions are all explosively expanded about simultaneously and the second portions of such regions are all explosively expanded about simultaneously.

14. A method for explosively expanding unfragmented formation toward a limited void in a subterranean formation comprising the steps of:

(a) excavating a limited void in a subterranean formation, while leaving a zone of unfragmented formation having a horizontally extending free face adjacent the void;

(b) forming an array of horizontally spaced apart explosive charges in the zone of unfragmented formation, said array extending about parallel to the horizontally extending free face;

(c) initiating detonation of a plurality of explosive charges at a plurality of first locations in the array spaced apart from each other in directions parallel to the free face; and thereafter in the same round (d) initiating detonation of explosive charges at locations in the array between the first spaced apart locations.

15. The method according to claim 14 wherein the plurality of first locations consists of four first locations in a square.

16. The method according to claim 14 wherein the plurality of first locations consists of five first locations in a quincunx.

17. A method for forming an in situ oil shale retort in a retort site in a subterranean formation containing oil shale, such as in situ oil shale retort containing a fragmented permeable mass of formation particles containing oil shale formed within top, bottom, and side boundaries of the retort site, comprising the steps of:

(a) excavating at least one void in the subterranean formation within the boundaries of the retort site while leaving a zone of unfragmented formation within the boundaries of the retort site adjacent such a void, the zone of unfragmented formation comprising a plurality of horizontally spaced contiguous regions wherein each such contiguous region has a horizontally extending free face adjacent the void;

(b) forming an array of explosive charges in the zone of unfragmented formation, the array comprising at least one first explosive charge in a central portion of each such region of the zone of unfragmented formation surrounded by a plurality of second explosive charges in a portion of each such region radially spaced from the central portion and adjacent the central portion; and (c) detonating the explosive charges in a single round for explosively expanding the zone of unfragmented formation toward the void for forming the fragmented permeable mass of formation particles in the in situ oil shale retort by:

(i) detonating the first explosive charges in each such region of the zone of unfragmented formation for explosively expanding the central portion of each such region toward the void; and thereafter (ii) detonating the second explosive charges in each such region of the zone of unfragmented formation for explosively expanding the portion of each region radially spaced from the central portion and adjacent the central portion, toward the void.

18. The method according to claim 17 wherein the void is a limited void.

19. The method according to claim 17 wherein all of such first explosive charges in all of the regions are detonated substantially simultaneously and all of such second explosive charges in all of the regions are detonated substantially simultaneously.

20. The method according to claim 17 wherein a time delay between detonation of the first explosive charges and detonation of the second explosive charges is at least about 1 millisecond per foot of distance between a first explosive charge and an adjacent second explosive charge.

21. The method according to claim 17 wherein the zone of unfragmented formation is rectangular in horizontal cross-section and comprises four regions of about equal size, such regions having rectangular free faces which meet at a common corner at about the center of said zone.

22. The method according to claim 17 wherein the zone of unfragmented formation comprises five regions, a center region at about the center of the zone of unfragmented formation and four outer regions surrounding the center region, wherein each such outer region is adjacent the center region.

23. The method according to claim 22 wherein each such region is about the same size.

24. A method for forming an in situ oil shale retort in a retort site in a subterranean formation containing oil shale, such an in situ oil shale retort containing a fragmented permeable mass of formation particles containing oil shale formed within top, bottom, and side boundaries of the retort site, the method comprising the steps of:

(a) excavating a void in the subterranean formation within the boundaries of the retort site, while leaving a zone of unfragmented formation adjacent the void, such a zone of unfragmented formation having a horizontally extending free face adjacent the void;

(b) explosively expanding, in a single round, formation from each of a plurality of horizontally spaced contiguous regions of such a zone of unfragmented formation toward the void for forming a fragmented permeable mass of formation particles in the retort, wherein each such region comprises a portion of the horizontally extending free face adjacent the void and is explosively expanded by:

(i) about simultaneously explosively expanding formation from a center portion of each such region toward the void; and thereafter (ii) about simultaneously explosively expanding formation toward the void from portions of each such region surrounding the center portion.

25. The method according to claim 24 wherein the zone of unfragmented formation is rectangular in horizontal cross-section and comprises four regions of about equal size, such regions having rectangular free faces which meet at a common corner at about the center of said zone.

26. The method according to claim 24 wherein the zone of unfragmented formation comprises five contiguous regions, a center region at about the center of the zone of unfragmented formation and four outer regions surrounding the center region, wherein each such outer region is adjacent the center region.

27. The method according to claim 26 wherein each such contiguous region is about the same size.

28. A method for forming an in situ oil shale retort in a retort site in a subterranean formation containing oil shale, such an in situ oil shale retort containing a fragmented permeable mass of formation particles containing oil shale within top, bottom, and side boundaries of the retort site, the method comprising the steps of:

(a) excavating a void in the subterranean formation within the boundaries of the retort site while leaving a zone of unfragmented formation within the boundaries of the retort site having a generally horizontally extending free face adjacent the void;

(b) placing a plurality of horizontally spaced apart first explosive charges in a first region of the zone of unfragmented formation and placing a plurality of horizontally spaced apart second explosive charges in a second region of the zone of unfragmented formation, said first and second regions being horizontally spaced contiguous regions each having a portion of the horizontally extending free face adjacent the void;

(c) detonating the first explosive charges in a single round by:

(i) detonating at least one first explosive charge located at about the center of the first region; and thereafter (ii) detonating a plurality of first explosive charges spaced apart from the center of the first region; and (d) detonating the second explosive charges in the same round by:

(i) detonating at least one second explosive charge located at about the center of the second region; and thereafter (ii) detonating a plurality of second explosive charges spaced apart from the center of the second region.

29. The method according to claim 28 wherein such charges at about the center of the first and second regions are detonated at about the same time.

30. A method for forming an in situ oil shale retort in a retort site in a subterranean formation containing oil shale, such an in situ oil shale retort containing a fragmented permeable mass of formation particles containing oil shale within top, bottom, and side boundaries of the retort site, the method comprising the steps of:

(a) excavating a void in the subterranean formation within the boundaries of the retort site leaving a zone of unfragmented formation adjacent the void, the surface of the zone of unfragmented formation defining a horizontally extending free face adjacent the void; and (b) explosively expanding a plurality of regions of the zone of unfragmented formation toward the free face for forming the fragmented permeable mass of formation particles in the in situ oil shale retort, wherein each such region is adjacent an area of the free face, and within each such area commencing explosive expansion of a first portion of formation near the center of the area followed by explosive expansion of a second portion of formation surrounding the center of the area.

31. The method according to claim 30 wherein the zone of unfragmented formation comprises four regions of about equal size wherein the free faces of such regions meet at a common corner at about the center of the zone of unfragmented formation.

32. The method according to claim 30 wherein the zone of unfragmented formation comprises five contiguous regions, a center region at about the center of the zone of unfragmented formation and four outer regions surrounding the center region.

33. The method according to claim 32 wherein the zone of unfragmented formation is generally rectangular in horizontal cross-section and each of the outer regions is adjacent the center region.

34. A method for forming an in situ oil shale retort in a retort site in a subterranean formation containing oil shale, such an in situ oil shale retort containing a fragmented permeable mass of formation particles containing oil shale formed within top, bottom, and side boundaries of the retort site, the method comprising the steps of:

(a) excavating at least one horizontally extending void in the subterranean formation within the boundaries of the retort site, while leaving a zone of unfragmented formation within the boundaries of the retort site having a horizontally extending free face adjacent such a void;

(b) explosively expanding such a zone of unfragmented formation toward the void in a plurality of vertically spaced layers which adjoin each other for forming the fragmented permeable mass of formation particles in the in situ retort by:

(i) explosively expanding a first vertically spaced adjoining layer of the zone of unfragmented formation toward the void; and thereafter (ii) explosively expanding a second vertically spaced adjoining layer of the zone of unfragmented formation toward the void, wherein at least one of the layers is expanded by approximately simultaneously explosively expanding a plurality of contiguous horizontally spaced regions of such a layer toward the void by the steps of:

(1) explosively expanding a first portion of each such contiguous horizontally spaced region toward the void, wherein said first portion of each such region is at about the center of such a region; and thereafter (2) explosively expanding a second portion of each such contiguous horizontally spaced region toward the void, wherein the second portion of each such region is adjacent the first portion and surrounds the first portion.

35. The method according to claim 34 wherein the first portions of all of such contiguous horizontally spaced regions of the layer are explosively expanded about simultaneously and the second portions of all of such contiguous horizontally spaced regions of the layer are explosively expanded about simultaneously.

36. The method according to claim 35 wherein the plurality of contiguous horizontally spaced regions consists of four regions of about equal size, said regions having a common corner.

37. The method according to claim 35 wherein the plurality of contiguous horizontally spaced regions consists of five regions, a center region at about the center of such a layer of unfragmented formation and four outer regions surrounding the center region.

38. The method according to claim 34 wherein one of such vertically spaced adjoining layers of unfragmented formation is explosively expanded toward the void by first explosively expanding a center portion of such a layer toward the void and thereafter by explosively expanding portions of the layer toward the void progressing in bands generally radially outwardly from said center portion.

39. A method for forming an in situ oil shale retort in a retort site in a subterranean formation containing oil shale, such an in situ oil shale retort containing a fragmented permeable mass of formation particles containing oil shale formed within top, bottom, and side boundaries of the retort site, the method comprising the steps of:

(a) excavating an upper, an intermediate, and a lower void within the boundaries of the retort site while leaving an upper zone of unfragmented formation extending between the upper and intermediate voids and a lower zone of unfragmented formation extending between the intermediate and lower voids, the upper zone having a horizontally extending upper free face defining the floor of the upper void and a horizontally extending lower free face defining the roof of the intermediate void and the lower zone having a horizontally extending upper free face defining the floor of the intermediate void and a horizontally extending lower free face defining the roof of the lower void;

(b) placing explosive charges into the upper and lower zones of unfragmented formation for explosively expanding said upper and lower zones toward the voids for forming the fragmented permeable mass of formation particles in the retort;

(c) explosively expanding at least one of the zones of unfragmented formation upwardly toward the adjacent void above it and downwardly toward the adjacent void below it by approximately simultaneously explosively expanding a plurality of horizontally spaced adjoining regions of such a zone toward said adjacent voids, each such region extending vertically between the upper and lower horizontally extending free faces, wherein each such region is explosively expanded toward the voids adjacent to it in a single round by:

(i) explosively expanding a first portion of each such region toward the voids, wherein the upper and lower horizontally extending free face of each such first portion is near the center of such a region; and thereafter (ii) explosively expanding a second portion of each such region toward the voids, wherein the upper and lower horizontally extending free face of each such second portion is adjacent the respective free face of each such first portion and surrounds the free face of each such first portion.

40. The method according to claim 39 wherein such a zone of unfragmented formation is square in horizontal cross-section and comprises four regions of about equal size, each such region having a square upper horizontally extending free face adjacent the void above it and a square lower horizontally extending free face adjacent the void below it, the free faces of the four regions meeting at a common corner at about the center of the zone of unfragmented formation.

41. The method according to claim 39 wherein such a zone of unfragmented formation comprises five contiguous regions, a center region at about the center of the zone and four outer regions surrounding the center region.

42. The method according to claim 39 comprising explosively expanding the other zone of unfragmented formation in a single round upwardly toward the adjacent void above it and downwardly toward the adjacent void below it by explosively expanding a center portion of such a zone of unfragmented formation and thereafter explosively expanding a portion of the zone of unfragmented formation located radially outwardly from the center portion.

43. The method according to claim 39 additionally comprising explosively expanding the other zone of unfragmented formation in a single round upwardly toward the adjacent void above it and downwardly toward the adjacent void below it by approximately simultaneously explosively expanding a plurality of horizontally spaced adjoining regions of such a zone toward said adjacent voids, each such region extending vertically between the upper and lower horizontally extending free faces, wherein each such region is explosively expanded toward the voids adjacent to it by:

(a) explosively expanding a first portion of each such region toward the voids, wherein the upper and lower horizontally extending free face of each such first portion is near the center of such a region; and thereafter (b) explosively expanding a second portion of each such region toward the voids, wherein the upper and lower horizontally extending free face of each such second portion is adjacent the respective free face of each such first portion and surrounds the free face of each such first portion.

44. The method according to claim 43 wherein the upper and lower zones of unfragmented formation are explosively expanded about simultaneously.

45. A method for forming an in situ oil shale retort in a retort site in a subterranean formation containing oil shale, such an in situ oil shale retort containing a fragmented permeable mass of formation particles containing oil shale formed within top, bottom, and side boundaries of the retort site, comprising the steps of:

(a) excavating a void in the subterranean formation within the boundaries of the retort site, while leaving a zone of unfragmented formation adjacent the void, the zone of unfragmented formation comprising five contiguous regions, each such region having a horizontally extending free face adjacent the void wherein a center region is at about the center of the zone of unfragmented formation and four outer regions surround the center region and are adjacent the center region;

(b) forming an array of explosive charges in the zone of unfragmented formation, the array comprising at least one first explosive charge in a central portion of each such region of the zone of unfragmented formation surrounded by a plurality of second explosive charges in a portion of each such region radially spaced from the central portion and adjacent the central portion; and (c) detonating the explosive charges in a single round for explosively expanding the zone of unfragmented formation toward the void for forming the fragmented permeable mass of formation particles in the in situ oil shale retort by:

(i) detonating the first explosive charges in each such region of the zone of unfragmented formation at about the same time for explosively expanding the central portion of each such region toward the void; and thereafter (ii) detonating the second explosive charges in each such region of the zone of unfragmented formation at about the same time for explosively expanding the portion of each region radially spaced from the central portion and adjacent the central portion toward the void.

46. The method according to claim 45 wherein the void is a limited void.

47. The method according to claim 45 wherein a time delay between detonation of the first explosive charges and detonation of the second explosive charges is at least about 1 millisecond per foot of distance between a first explosive charge and an adjacent second explosive charge.

48. A method for forming an in situ oil shale retort in a retort site in a subterranean formation containing oil shale, such an in situ oil shale retort containing a fragmented permeable mass of formation particles containing oil shale formed within top, bottom, and side boundaries of the retort site, comprising the steps of:

(a) excavating a void in the subterranean formation within the boundaries of the retort site, while leaving a zone of unfragmented formation adjacent the void, the zone of unfragmented formation comprising four regions of about equal size, such regions having square free faces which meet at a common corner at about the center of the zone;

(b) forming an array of explosive charges in the zone of unfragmented formation, the array comprising at least one first explosive charge in a central portion of each such region of the zone of unfragmented formation surrounded by a plurality of second explosive charges in a portion of each such region radially spaced from the central portion and adjacent the central portion; and (c) detonating the explosive charges in a single round for explosively expanding the zone of unfragmented formation toward the void for forming the fragmented permeable mass of formation particles in the in situ oil shale retort by:

(i) detonating the first explosive charges in each such region of the zone of unfragmented formation about simultaneously for explosively expanding the central portion of each such region toward the void; and thereafter (ii) detonating the second explosive charges in each such region of the zone of unfragmented formation about simultaneously for explosively expanding the portion of each such region radially spaced from the central portion and adjacent the central portion toward the void.

49. The method according to claim 48 wherein the void is a limited void.

50. The method according to claim 48 wherein a time delay between detonation of the first explosive charges and detonation of the second explosive charges is at least about 1 millisecond per foot of distance between a first explosive charge and an adjacent second explosive charge.

* * * * *

UNITED STATES PATENT AND TRADEMARK OFFICE

CERTIFICATE OF CORRECTION

PATENT NO. : 4,423,908

DATED : January 3, 1984

INVENTOR(S) : THOMAS E. RICKETTS

It is certified that error appears in the above-identified patent and that said Letters Patent is hereby corrected as shown below:

Column 12, line 6, "80b" should read -- 80a --.

Column 12, line 24, "80b" should read -- 80d --.

Signed and Sealed this

First Day of May 1984

(SEAL)

*Attest:*

GERALD J. MOSSINGHOFF

*Attesting Officer*

*Commissioner of Patents and Trademarks*